US009415254B2

(12) United States Patent
Dyer

(10) Patent No.: US 9,415,254 B2
(45) Date of Patent: Aug. 16, 2016

(54) EXERCISE DEVICE

(71) Applicant: Rebecca R. Dyer, Hebron, KY (US)

(72) Inventor: Rebecca R. Dyer, Hebron, KY (US)

( * ) Notice: Subject to any disclaimer, the term of this patent is extended or adjusted under 35 U.S.C. 154(b) by 0 days.

(21) Appl. No.: 14/692,190

(22) Filed: Apr. 21, 2015

(65) Prior Publication Data

US 2015/0297938 A1 Oct. 22, 2015

Related U.S. Application Data

(60) Provisional application No. 61/981,992, filed on Apr. 21, 2014.

(51) Int. Cl.
*A63B 21/02* (2006.01)
*A63B 21/055* (2006.01)
(Continued)

(52) U.S. Cl.
CPC ..... *A63B 21/0557* (2013.01); *A63B 21/00043* (2013.01); *A63B 21/00061* (2013.01);
(Continued)

(58) Field of Classification Search
CPC ..... A63B 21/1403; A63B 21/1407; A63B 21/1411; A63B 21/1415; A63B 21/1419; A63B 21/1423; A63B 21/1426; A63B 21/1434; A63B 21/1438; A63B 21/1442; A63B 21/0557; A63B 19/0037; A63B 5/00; A63B 5/16; A63B 2005/163; A63B 7/00; A63B 7/02; A63B 7/04; A63B 7/045; A63B 7/08; A63B 7/085; A63B 21/04; A63B 21/0442; A63B 21/055; A63B 21/0552; A63B 21/0555; A63B 21/065; A63B 21/063; A63B 21/4001; A63B 2023/006; A63B 23/035; A63B 2208/0285; A63B 2208/029; A41D 19/0037; A41D 1/08; A41D 27/10; A41B 1/08; A61H 1/00; A61H 1/02; A61H 1/0234; A61H 1/024; A61H 1/0244; A61H 1/0274; A61H 2201/00; A61H 2201/0157; A61H 2201/1645; A61H 2201/16; A61H 2201/1619; A61H 2201/1621; A61H 2201/164; A61H 2201/1642; A61H 2205/00; A61H 2205/08; A61H 2205/081; A61H 2205/083; A61H 2205/084; A61H 2205/10; A61H 2205/106; A61H 2205/108
USPC ..... 2/160, 326, 233, 322
See application file for complete search history.

(56) References Cited

U.S. PATENT DOCUMENTS 2,333,428 A * 11/1943 Kinsey ..... A41D 27/10 2/160
2,626,396 A * 1/1953 Kanin ..... 2/269
(Continued)

OTHER PUBLICATIONS

Atreq Power Jumper, printed Feb. 13, 2014, from www.mcsport.ie/p/atreq-power-jumper/atq120 , 4 pgs.
(Continued)

*Primary Examiner* — Oren Ginsberg
*Assistant Examiner* — Megan Anderson
(74) *Attorney, Agent, or Firm* — Frost Brown Todd LLC

(57) ABSTRACT

An exercise apparatus comprises a wearable article and a plurality of straps. The wearable article may comprise pants, footwear, headwear, jackets, gloves, socks, shorts, shirts, vests, sleeves, unitards, and/or leotards. The straps may be positioned at various locations about the wearable article. The straps include a plurality of tabs exposed through corresponding openings in the wearable article. Each tab includes an attachment member that is capable of being selectively coupled with one or more exercise accessories. The tabs may be positioned equidistantly about each strap. The exercise accessories may comprise straps, static or flexible bands, rods, levels, poles, chains, resistance bands, weights, sandbags, weighted sleds, training parachutes, medical rehabilitation tools (such as stretch bands), or the like. The wearable article or straps may further include a plurality of snaps such that the tabs are selectively securable to the snaps.

20 Claims, 14 Drawing Sheets

(51) Int. Cl.

| | |
|---|---|
| ***A63B 21/00*** | (2006.01) |
| ***A63B 21/04*** | (2006.01) |
| ***A63B 21/065*** | (2006.01) |
| ***A63B 21/068*** | (2006.01) |
| *A63B 23/00* | (2006.01) |

(52) U.S. Cl.

CPC ..... *A63B21/00069* (2013.01); *A63B 21/00178* (2013.01); *A63B 21/00185* (2013.01); *A63B 21/0442* (2013.01); *A63B 21/065* (2013.01); *A63B 21/068* (2013.01); *A63B 21/4005* (2015.10); *A63B 21/4007* (2015.10); *A63B 21/4009* (2015.10); *A63B 21/4011* (2015.10); *A63B 21/4015* (2015.10); *A63B 21/4019* (2015.10); *A63B 21/4025* (2015.10); *A63B 21/4034* (2015.10); *A63B 21/4035* (2015.10); *A63B 21/4043* (2015.10); *A63B 2023/006* (2013.01)

(56) References Cited

U.S. PATENT DOCUMENTS

| | | | | | |
|---|---|---|---|---|---|
| 4,062,066 | A * | 12/1977 | Weiss | 2/322 | |
| 4,910,802 | A * | 3/1990 | Malloy | A41D 13/0015 2/227 | |
| 5,129,647 | A | 7/1992 | Castellanos | | |
| 5,306,222 | A | 4/1994 | Wilkinson | | |
| 5,545,113 | A | 8/1996 | Bobich | | |
| 5,720,042 | A | 2/1998 | Wilkinson | | |
| 6,554,747 | B1 | 4/2003 | Rempe | | |
| 7,707,652 | B2 | 5/2010 | Senegal | | |
| 7,874,970 | B2 | 1/2011 | Glisan | | |
| 2005/0177920 | A1 | 8/2005 | Wilkinson | | |
| 2005/0227833 | A1 | 10/2005 | Wilkinson | | |
| 2005/0261113 | A1 | 11/2005 | Wilkinson | | |
| 2006/0183609 | A1 | 8/2006 | Flynn | | |
| 2007/0004571 | A1 * | 1/2007 | Gonzalez | 482/124 | |
| 2007/0010380 | A1 | 1/2007 | Wilkinson | | |
| 2007/0015640 | A1 | 1/2007 | Demeniuk | | |
| 2007/0060454 | A1 | 3/2007 | Vogel | | |
| 2007/0289045 | A1 | 12/2007 | Evans et al. | | |
| 2010/0222189 | A1 | 9/2010 | Washington | | |
| 2011/0207585 | A1 * | 8/2011 | Burns | 482/124 | |
| 2011/0301001 | A1 | 12/2011 | Hopper | | |
| 2012/0202658 | A1 | 8/2012 | Menefee, Sr. | | |
| 2013/0150218 | A1 | 6/2013 | Mial | | |
| 2013/0331241 | A1 | 12/2013 | Spina | | |
| 2015/0031511 | A1 * | 1/2015 | Matthews | 482/124 | |
| 2015/0065317 | A1 * | 3/2015 | Washington | 482/124 | |

OTHER PUBLICATIONS

Atreq Speed Resistor, printed Feb. 13, 2014 from www.mcsport.ie/p/atreq-speed-resistor/atq106, 4 pgs.

SKLZ Hopz Vertical Jump Trainer, printed Feb. 13, 2014 from www.amazon.com/SKLZ-Hopz-Vertical-Jump_Trainer/dp/B002CLK2GC, 12 pgs.

* cited by examiner

EXERCISE DEVICE

This application claims priority of U.S. Provisional Patent Application Ser. No. 61/981,992, filed Apr. 21, 2014, entitled "Exercise Device".

BACKGROUND

Described herein are embodiments of a system of exercise devices and accessories, including but not limited to wearable articles, such as functional or exercise apparel, that may be used to enable and enhance various activities, including but not limited to stretching, strength and agility training, physical therapy, and other activities. Some embodiments of the present invention comprise apparel for use in exercise, rehabilitation, and stretching with a unique design that enables a user to affix various tools and implements securely to their body. In some embodiments, the apparel may feature a built-in series of continuous, independent, padded or non-padded straps firmly secured to the interior of the pants with tabs that extend from each strap through to the exterior. In these embodiments, the tabs contain attachment members, such as grommets or eyelets, to which a variety of accessories can be connected.

Embodiments of the present invention may feature a series of secure, independent padded straps that provide a user with a means to quickly and firmly attach stretching and exercise accessories to a particular location on the user's body. These built-in straps may reduce the risk of slippage of accessories, thereby enhancing the safety and effectiveness of the activity.

While a variety of exercise devices and exercise accessories have been made and used, it is believed that no one prior to the inventor has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
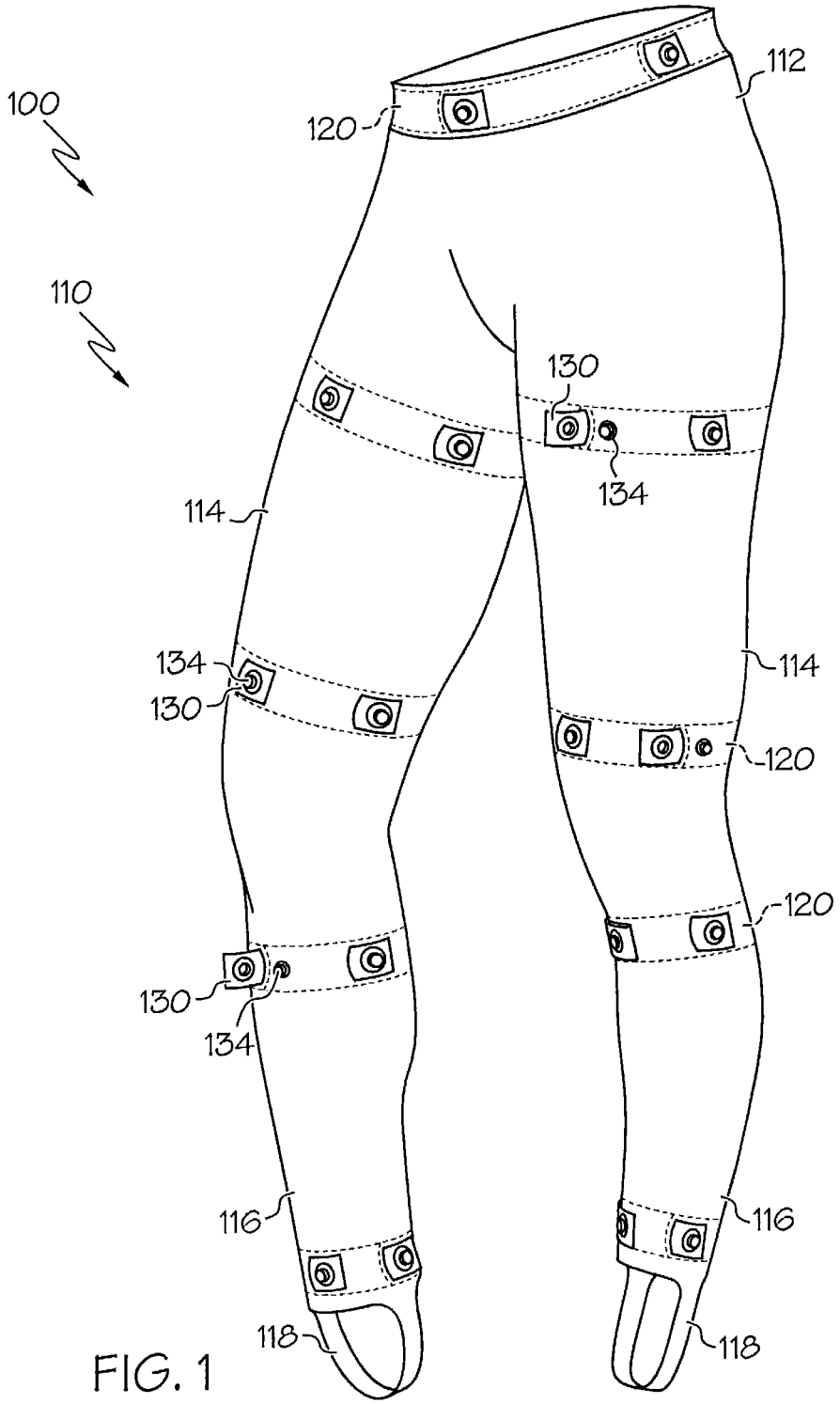
FIG. 1 depicts a perspective view of an exemplary exercise device comprising a pair of pants.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious forms and purposes, all without departing from the invention. Accordingly, the drawings and descriptions should be regarded as illustrative in nature and not restrictive.

Figure 2:
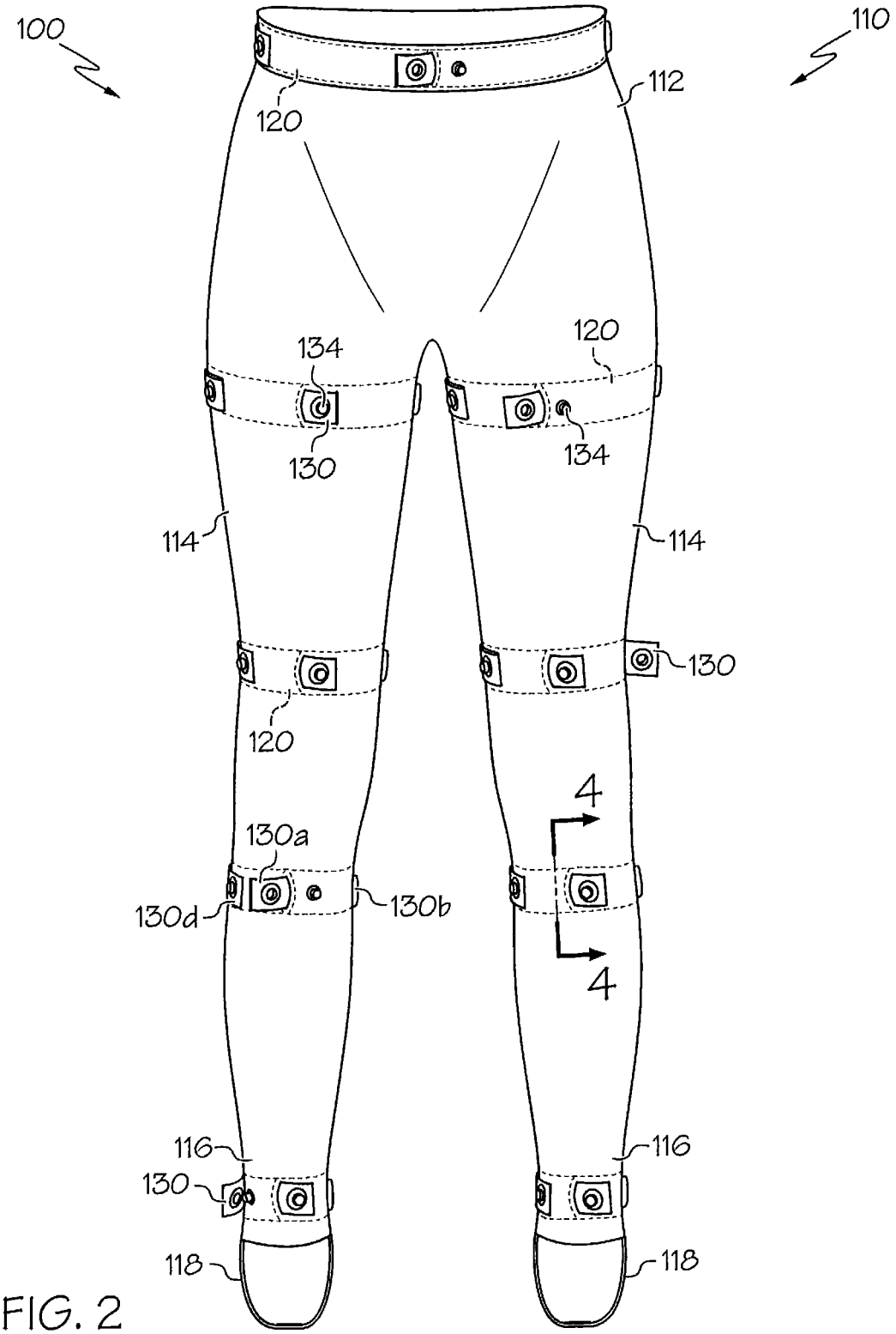
FIG. 2 depicts a front view of the exercise device of FIG. 1.
Figure 3:
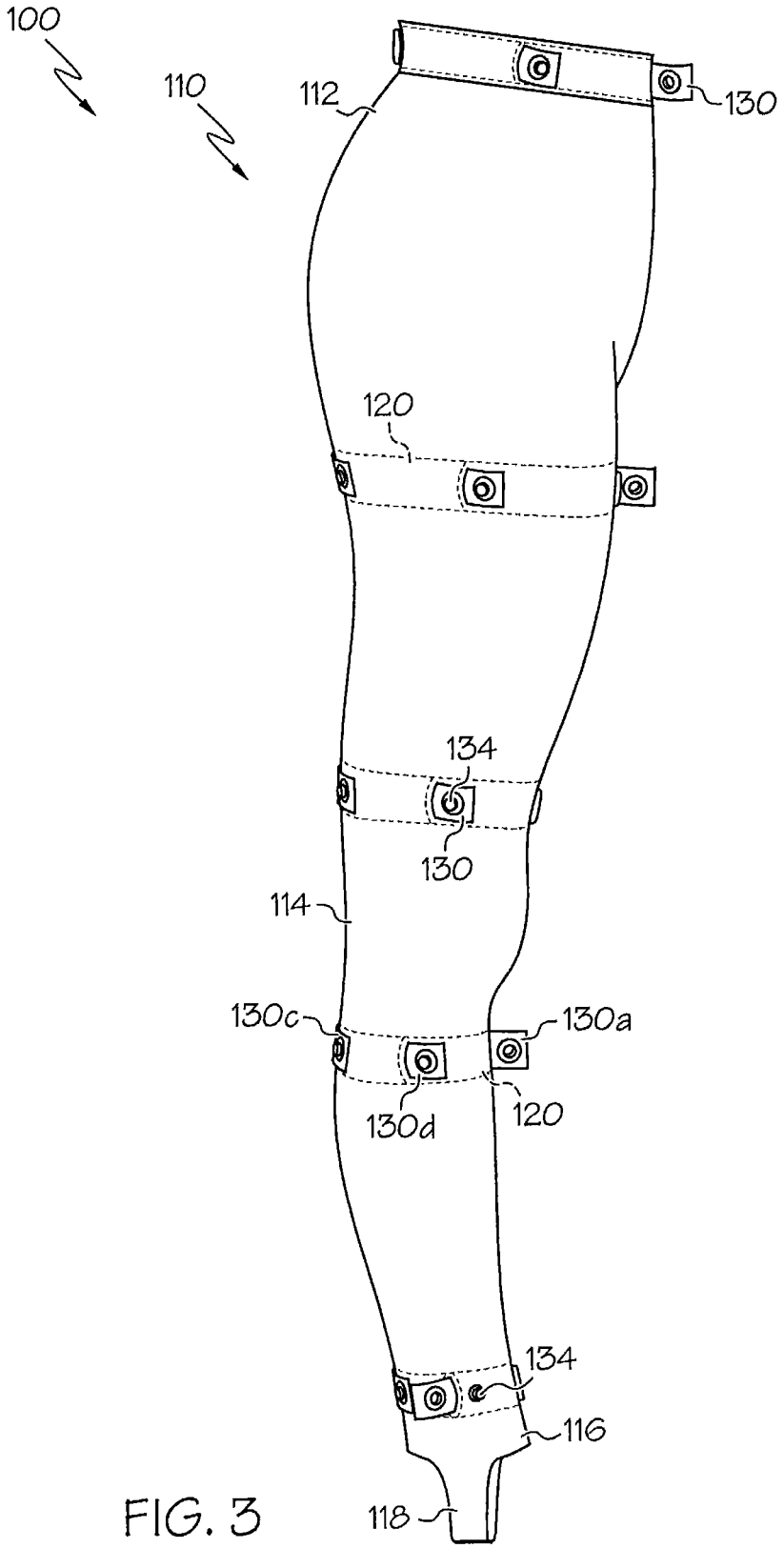
FIG. 3 depicts a side view of the exercise device of FIG. 1.

FIGS. 1-3 illustrate an exemplary exercise device (100). Exercise device (100) comprises pants (110) having a plurality of substantially continuous straps (120) (shown in phantom) with tabs (130) protruding through to the exterior of the pants at various locations on pants (110). Pants (110) are shown as having a waist (112), legs (114), and bottoms (116). Waist (112) is shown as having at least one strap (120) mounted within the top of waist (112). Legs (114) are shown as having six straps (120) with three straps (120) mounted on each leg (114). Bottoms (116) are shown as having one strap (120) per leg (114). Additionally, bottoms (116) are shown as having stirrups (118). Stirrups (118) may permit the pants (110) to stay in one position relative to a user's leg. It should be understood that stirrups (118) are merely optional and may be omitted entirely or replaced with a sealed end such that pants may be configured to enclose the feet of a user.

As can be seen in FIGS. 1-3, pants (110) are configured to approximately fit the anatomy of the user. In particular, waist (112), legs (114), and bottoms (116) are shown as corresponding to anatomical features of a user (e.g., buttocks, quadriceps, hamstrings, knees, calves, ankles, and the like). In other examples, pants (110) may have varying degrees of fit with respect to the anatomy of a user. By way of example only, in some embodiments pants (110) may be relatively loose relative to the anatomical features of a user. Yet in other embodiments, pants (110) may be relatively tight relative to the anatomical features of a user. Other relationships between the fit of pants (110) and anatomical features of a user will be apparent to those of ordinary skill in the art in view of the teachings herein.

In addition to fit, pants (110) may also be configured to stretch to accommodate various motions that a user may engage in during exercise and/or other physical activity. For instance, pants (110) may be constructed of a stretch fabric such as spandex, elastane or any other material having elastomeric physical properties.

As described above, pants (110) may have a plurality of straps (120) incorporated within pants (110) and placed at different locations along the length of pants (110). In this embodiment, straps (120) are independent of one another. Although, pants (110) in the illustrated embodiment are shown as having a particular arrangement of straps (120), other embodiments may have straps situated in other suitable arrangements. Indeed, pants (110) may have any suitable number and/or arrangement of straps (120). Additionally, tabs (130) of straps (120) protrude from pants (110) at various locations. Tabs (130) extend out from straps (120) and through pants (110) to form an anchor point for attaching one or more exercise accessories. As shown, each strap (120) includes four tabs (130) that protrude from pants (110) in opposing directions. Straps (120) may include any suitable number of tabs (130) positioned in any suitable manner about each respective strap (120). Specifically, in the illustrated embodiment each strap (120) includes one tab (130*a*) that protrudes from the front of pants (110), one tab (130*b*) that protrudes from a first side of pants (110), one tab (130*c*) that protrudes from the rear of pants (110) and one tab (130*d*) that protrudes from the opposite side of pants (110). Having a plurality of tabs (130) that each extending in opposing directions may be advantageous because it allows a user to extend a leg or arm in multiple directions and it also allows a user to attach more than one exercise accessory that can be used to simultaneously apply force in multiple directions. By way of example only, a user may attach one end of a first resistance band to tab (130*c*) and secure the opposite end of that first resistance band to a stationary structure. The user may further attach one end of a second resistance band to tab (130*a*) and using his or her hand, pull on the other end of the second resistance band.

By way of example only, a user may attach one end of a resistance band or strap to a tab (130) on the user's leg via the attachment member (132) and use their hand on the other end of the strap to pull and stretch the leg. In other applications, the user may attach an exercise accessory to two or more attachment members (132)/tabs (130) at a time. For example, a user could attach one end of a resistance band to a tab (130) located on the user's right leg and attach the other end to a tab (130) on the user's left leg and apply outward force to exercise both legs. Accordingly, in some applications, such as those described in the preceding sentences, there is no need to connect the exercise accessory to an external object. By attaching the exercise accessory to exercise device (100) via attachment members (132) in tabs (130), the user can substantially become a self-contained gym, thereby allowing the user to stretch and exercise anytime, anywhere.

In addition, as shown in FIGS. 1-3, the position of each strap (120) on each leg of pants (110) corresponds to the position of a strap (120) on the opposite leg of pants (110). This corresponding arrangement of straps (120) combined with the fact that each strap (120) includes tabs (130) that extend in opposing directions may be beneficial because it may help the user apply symmetrical forces the user's legs if multiple exercise accessories are attached during a particular activity. This particular arrangement may facilitate attachment of an exercise accessory between straps (120) on opposite legs so that resistance is provided simply by moving his or her legs back and forth. As will be described in greater detail below, tabs (130) of straps (120) may be selectively secured to a snap (134). Although shown as being secured to strap (120) of the present example, it should be understood that snap (134) may be additionally or alternatively secured to pants (110). In the illustrated embodiment, some tabs (130) are shown as being secured to snap (134) (i.e., in a "secured position"), while other tabs (130) are shown as being free from snap (134) (i.e., in a "freed position"). Allowing tabs (130) to be transitioned from a freed position to a secured position may provide a more aesthetically pleasing and wearable article by allowing the wearable article, such as pants (110), shirt (210), glove (310), footwear (410) or sleeve (510*a*, 510*b*), to more closely resemble a typical wearable article (i.e. one without any type of exercise device incorporated therein) when tabs (130) are in the secured position. In addition, positioning tabs (130) in the secured position during laundering may facilitate care of the wearable article by preventing tabs (130) from snagging on internal components of a washing machine and/or dryer while being laundered. Furthermore, securing tabs (130) that are not currently being used in a secured position may facilitate the desired activity by providing a more streamlined and aerodynamic wearable article than if all of the tabs (130) are in a freed position and by preventing the unused tabs (130) from flapping against a user during use.

Figure 4:
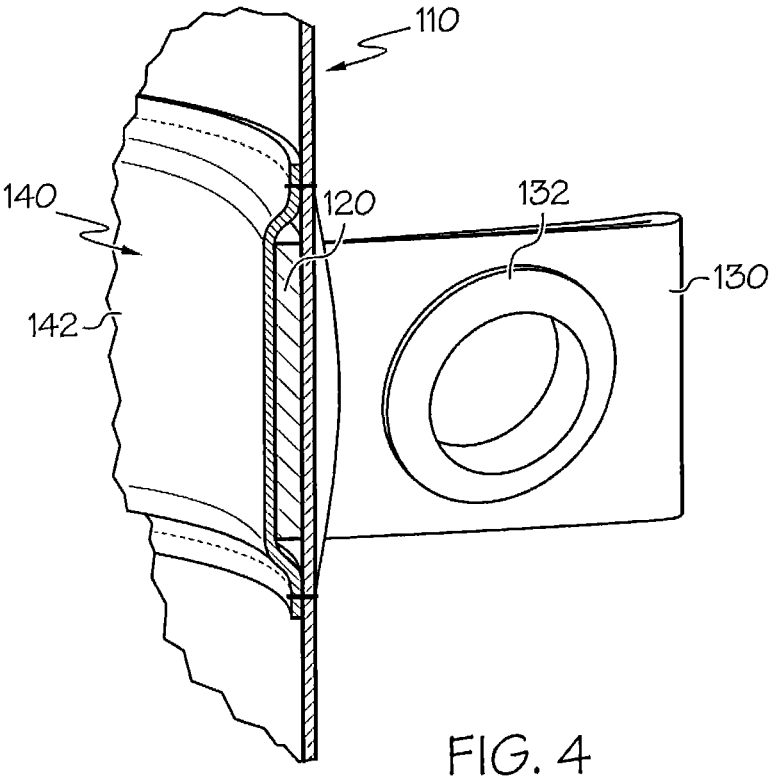
FIG. 4 depicts a partial cross-sectional view of the exercise device of FIG. 1 where the cross section is taken along line 4-4 of FIG. 2.

FIG. 4 illustrates a partial cross-sectional view of strap (120) attached to pants (110). In particular, the interior of pants (110) is shown as having an interior pocket (140) surrounding strap (120). Pocket (140) is formed by a pocket material (142) sewn to the interior surface of pants (110). Strap (120) is therefore held in place between the fabric of pants (110) and pocket material (142). In addition to securing strap (120) in place, pocket (140) may also provide padding to protect a user's skin from abrasive contact with strap (120). The pocket material (142) may be comprised of any material suitable to provide the desired level of padding and security. Alternatively, strap (120) may itself comprise a padded material suitable to provide the desired level of padding, while in other embodiments, the strap (120) may comprise non-padded material. It should be understood that strap (120) may be held in place inside pants (110) by any suitable means or method. In other examples, strap (120) itself may be sewn or ultrasonically welded in place directly to the interior surface of pants (110), omitting pocket (140) entirely. Yet in other examples, strap (120) may be of integral construction with pants (110). As shown, each strap (120) is located on the interior of pants (110), which may be beneficial because it results in a more aesthetically pleasing wearable article. Positioning straps (120) on the interior of pants (110) allows pants to more closely resemble a normal pair of pants, particularly when tabs (130) are folded down and secured to their respective snaps (134) in a secured position. In other embodiments, the straps may be incorporated within the wearable article such that they are positioned on the exterior of the wearable article.

In some embodiments, one or more of the straps (120) may be removable from the wearable article, such as pants (110), shirt (210), glove (310), footwear (410) or sleeve (510*a*, 510*b*). By way of example only, pocket (140) may be configured to allow a user to selectively open and close pocket (140) to insert or remove a strap (120). Other conventional methods of removing straps (120) from the wearable article may also be utilized without going beyond the scope of the present invention. In such an embodiment where one or more of the straps (120) are removable, a user may position the removed strap(s) (120) on his or her body and utilize the strap(s) (120) as part of an exercise and/or activity as described herein independently of the wearable article. It may be beneficial to remove one or more of the straps (120) for laundering, repair or replacement, to place the strap (120) in a custom or specific location on the user's body, or for any other suitable reason.

Figure 5:
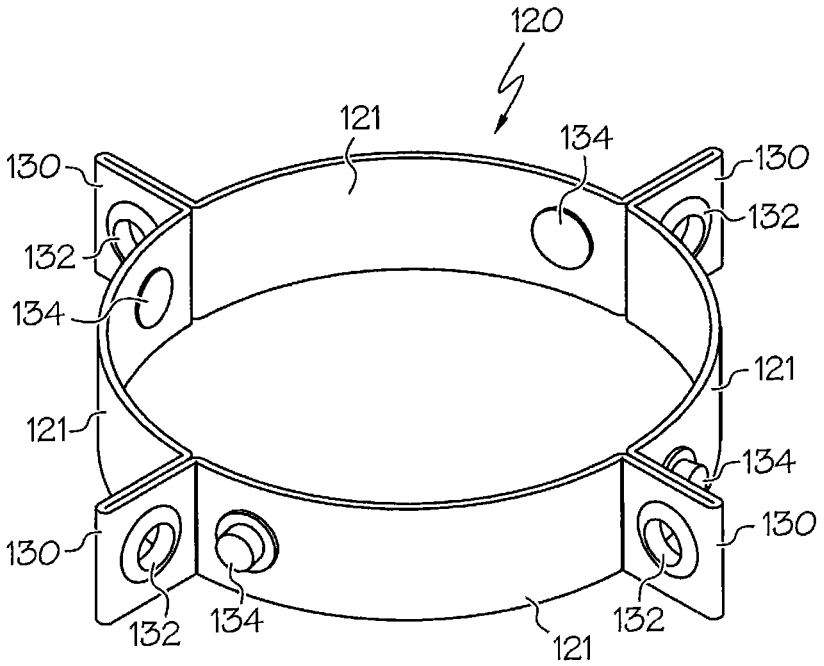
FIG. 5 depicts a perspective view of an exemplary strap of the exercise device of FIG. 1.
Figure 6:
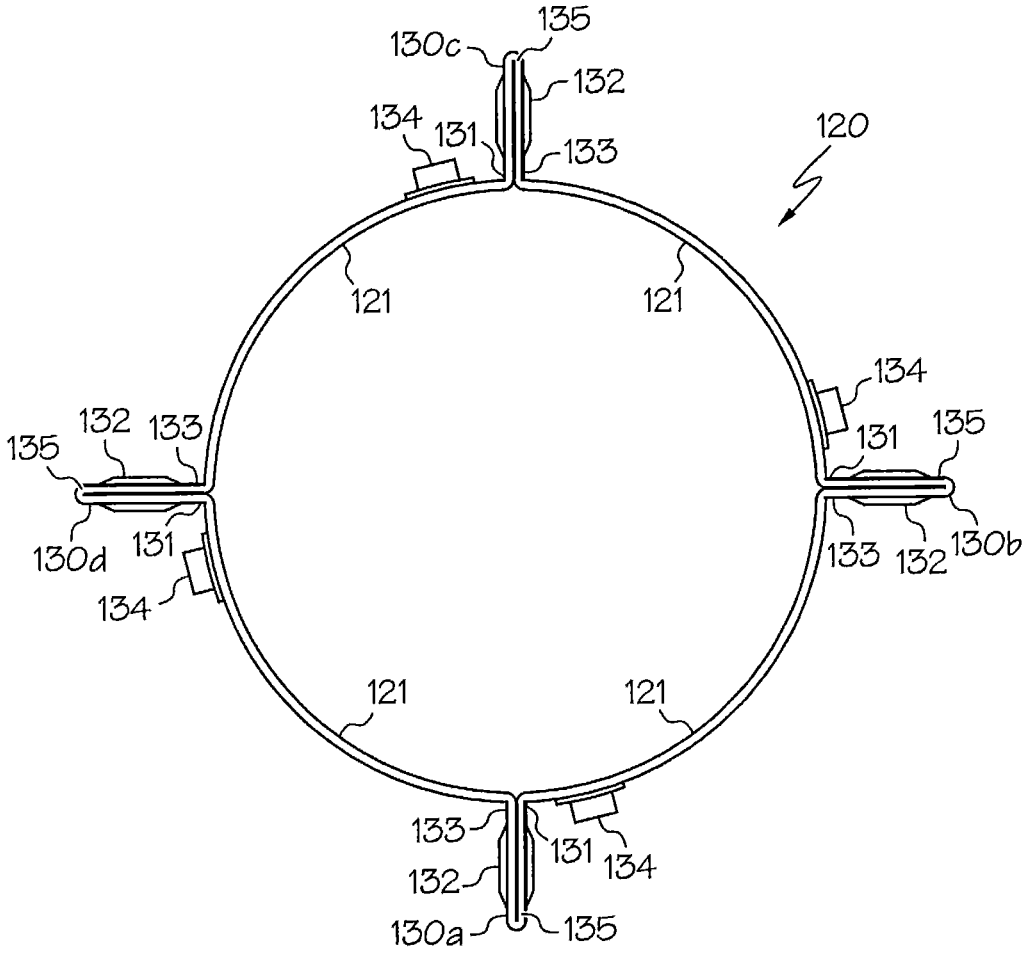
FIG. 6 depicts a top view of the strap of FIG. 5.
Figure 7:
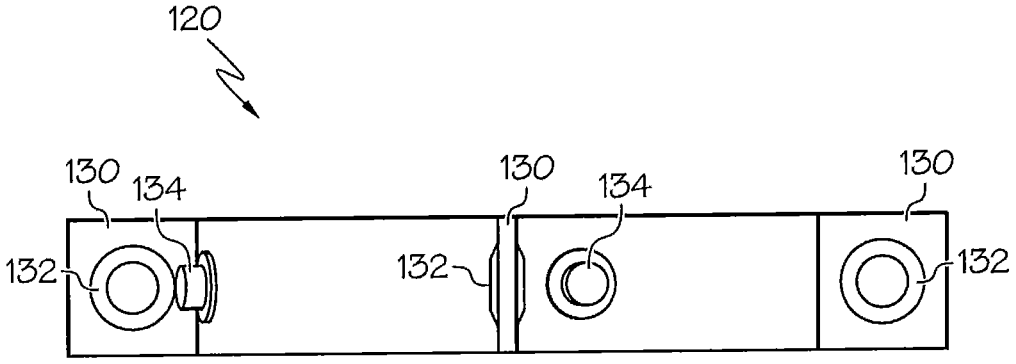
FIG. 7 depicts a side view of the strap of FIG. 5.

FIGS. 5-7 illustrate an exemplary strap (120) configuration. Strap (120) comprises tabs (130), interior sections (121) that extend between adjacent tabs (130), attachment members (132) positioned on each tab (130), and snaps (134) positioned on respective interior sections (121). As shown, tabs (130) are positioned equidistantly about strap (120) and extend from an exterior surface of strap (120). In the present example, strap (120) is shown as having a substantially continuous design with integral tabs (130). That is, strap (120) is constructed of a single piece of material with tabs (130) formed by bending the strap (120) into a suitable geometry. In the illustrated embodiment, each tab (130) comprises a first tab member (131) and a second tab member (133) that abut each other. Each first tab member (131) is integral with a corresponding interior section (121) at a proximal end of the first tab member (131). Similarly, each second tab member (133) is also integral with a corresponding interior section (121) at a proximal end of the second tab member (133). The integral construction of the tab members (131, 133) and the corresponding interior sections (121) of ring (120) may provide increased strength. The distal end of each first tab member (131) can be connected to the distal end of the corresponding, adjacent and abutting second tab member (133) via a fold (135) in the material, as is most clearly shown in FIGS. 5 and 6. In alternative embodiments, the distal end of each of the first tab members and second tab members may comprise free ends without the fold (135) so that the corresponding, adjacent and abutting first tab members and second tab members are separate members that are attached to each other with an attachment member (as described below), adhesive, sewing, welding and/or other suitable mechanical fastening means.

As shown, each tab (130) includes one attachment member (132) and strap (120) may include a corresponding snap (134) for each tab (130). In this embodiment, each snap (134) comprises a post configured to engage a corresponding attachment member (132) on the tab (130) adjacent to the respective snap (134). Generally, each snap (134) comprises a male member and each attachment member (132) comprises a corresponding female member cooperatively configured to engage each other by any suitable means such as compression fit, snap fit, mechanical engagement, or the like. Alternatively, the male/female relationship between each snap and attachment member may be reversed, provided the attachment member is still configured to engage a clip or other fastening mechanism on an exercise accessory. Other embodiments may include any suitable number of attachment members (132) and/or snaps (134). In embodiments where snaps (134) are included on strap (120), pants (110) include a slit or opening above or around each snap (134) so that each attachment member (132) can receive and/or engage a corresponding snap (134) to secure each tab (130) in a secured position.

In FIGS. 5-7, strap (120) is shown as having a particular diameter. However, it should be understood that each strap (120) attached to pants (110) may vary in diameter depending on the particular location on the pants (110) the particular pants (110) may have a larger diameter relative to strap (120) mounted at bottoms (116) of pants (110). Additionally, strap (120) diameters may vary depending on the size of the user for which pants (110) are designed. For instance, if pants (110) are designed for a larger user, straps (120) may all have a larger corresponding diameter. Other configurations of varying strap diameters will be apparent to those of ordinary skill in the art in view of the teachings herein. In some embodiments, the straps (120) may be configured and dimensioned to wrap securely around the corresponding body part of the user to minimize friction on the body part when force is applied to the tabs (130), which may reduce slipping and tugging. As a result, the straps (120) may remain stable and secure during the exercise activity. Furthermore, in some embodiments one or more straps (120) may be adjustable with regard to their diameter. By way of example only, in such an embodiment a strap may incorporate a tension lock buckle or any other conventional type of buckle or other conventional means for adjusting the diameter of the strap.

Strap (120) may comprise a strong fabric woven as a flat strip. By way of example only, materials used to weave the fabric may consist of nylon, polypropylene, Kevlar®, cotton, elastic, and combinations thereof. A woven fabric may be used for strap (120) to achieve suitable tensile strength. However, a woven fabric is not required. In other examples, strap (120) may consist of a substantially solid synthetic or natural material, such as leather or rubber. Strap (120) may comprise any suitable material capable of providing the desired strength to withstand the forces applied to strap (120) via an exercise accessory during use. In addition, strap (120) preferably comprises a substantially inelastic material that is dimensioned and configured to fit snugly around a user without applying a compressive force to the user's muscles that are adjacent to a particular strap (120). The substantially inelastic nature of the material may be beneficial because it may help prevent strap (120) from slipping along a user's body part during use. By way of example only, the straps (120) may comprise belting webbing or trim provided by the WM Wright Company. Other suitable materials for straps (120) will be apparent to those of ordinary skill in the art in view of the teachings herein. Strap (120) and the corresponding tabs (130) on strap (120) may comprise the same type of material. Furthermore, as discussed above, in some embodiments, strap (120) and tabs (130) may or may not be constructed of a single piece of material.

Tabs (130) are shown as having attachment members (132). Specifically, in the illustrated embodiment, each tab (130) includes one attachment member (132). In other embodiments, a tab (130) may include two or more attachment members (132). In particular, attachment members (132) are formed by an eyelet, grommet, or similar device or piece of hardware fixed through a hole in tab (130). Attachment members (132) are configured to make changing or moving exercise accessories quick and easy, thereby allowing a user to quickly and easily transition between exercise accessories. Attachment members (132) may comprise any appropriate material, including but not limited to, metal, plastic, rubber, etc. Attachment members (132) may be oriented substantially vertically as shown in FIG. 5, or alternatively substantially horizontally as will be understood by one of ordinary skill in the art according to the teachings herein. As shown, attachment members (132) are positioned substantially in the center of their respective tabs (130). It will be appreciated that in other embodiments, attachment members may be positioned along any suitable portion of tab, including but not limited to adjacent to the free end of a tab (130) or adjacent to the fixed end of a tab (130). As will be described in greater detail below, attachment members (132) are configured to permit an exercise accessory (150) to be attached to pants (110) via tabs (130). Exercise accessories include accessories or devices used to facilitate or enhance an exercise or activity, such as stretching, strength training (alone or with a partner), yoga, pilates, physical therapy maneuvers, rehabilitation activities, suspension, and other similar activities. Examples of such an exercise accessory (150) include, but are not limited to, straps, static or flexible bands, rods, levels, poles, chains, resistance bands, weights, sandbags, weighted sleds, training parachutes, medical rehabilitation tools (such as stretch bands), or the like. Additionally, in the illustrated embodiment, attachment members (132) are also configured to secure folds (135) in strap (120) that form each tab (130). In particular, each attachment member (132) is configured to engage and attach a first tab member (131) to a corresponding adjacent second tab member (133) thereby securing the respective tab members (131, 133) to one another. As noted above, an alternate attachment method or means, such as adhesive, sewing or welding may be used in addition to or instead of using the corresponding attachment member (132) to attach corresponding adjacent tab members (131, 133).

Still referring to FIGS. 5-7, each tab (130) is shown as having a corresponding adjacent snap (134). As described above, snap (134) may be used to selectively secure tab (130) to pants (110). In particular, snap (134) is configured to engage a corresponding attachment member (132) allowing attachment member (132) to be selectively secured to snap (134) such that attachment member (132) rests adjacent an exterior surface of strap (120) or pants (110) so as to limit the profile of attachment member (132) relative to strap (120) when not in use. Snap (134) may engage attachment member (132) by any suitable means such as compression fit, snap fit, magnetic engagement, mechanical engagement, or the like. When snaps (134) are located on straps (120), as shown in FIGS. 5-7, at least a portion of each snap (134) may protrude through a corresponding opening in the material of the wearable article, such as pants (110), shirt (210), glove (310), footwear (410) or sleeve (510*a*, 510*b*).

Attachment members (132) and snaps (134) may be comprised of any suitable material comprised to provide desired strength and durability. Examples of suitable materials may include metals such as brass, aluminum, plain carbon steel, stainless steel, nickel, copper, or the like; or plastics such as nylon, high density polyethylene (HDPE), acrylic, Kevlar®, or the like. Additionally, the material of attachment members (132) and snaps (134) may be consistent between the two, or may vary. Other suitable materials for attachment members (132) and snaps (134) will be apparent to those of ordinary skill in the art in view of the teachings herein.

Figure 8:
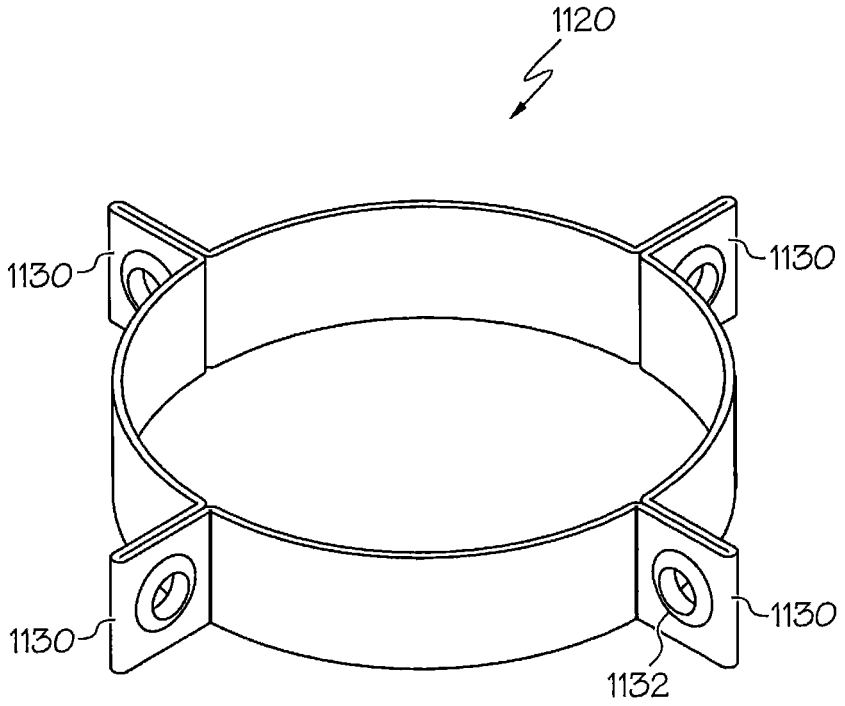
FIG. 8 depicts a perspective view of an alternate exemplary strap that may be used as part of the exercise device of FIG. 1 with the snaps removed from the strap.
Figure 9:
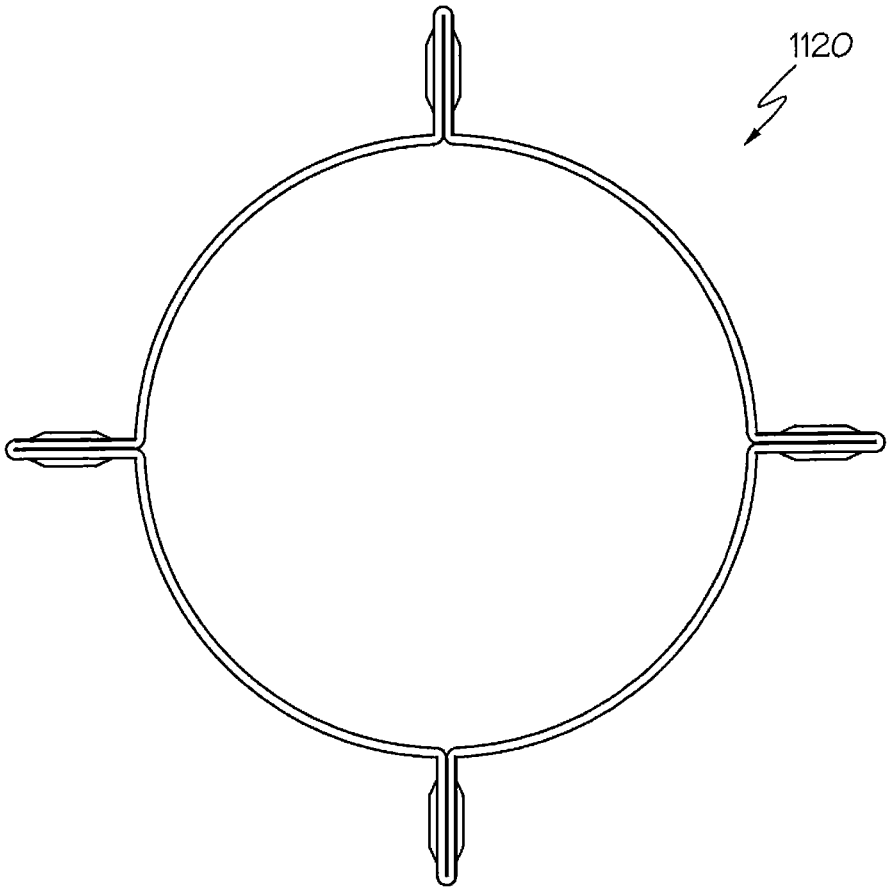
FIG. 9 depicts a top view of the strap of FIG. 8.
Figure 10:
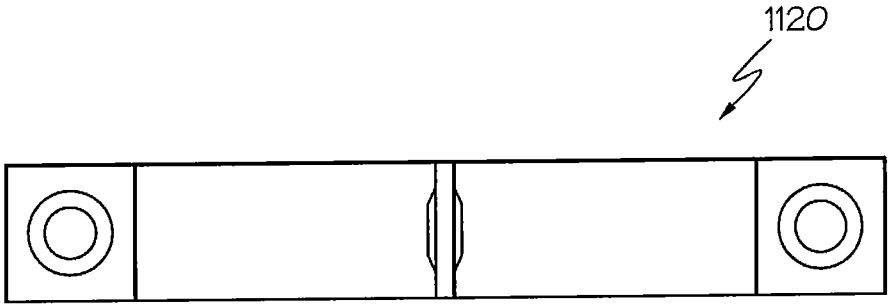
FIG. 10 depicts a side view of the strap of FIG. 8.

FIGS. 8-10 illustrate an alternate embodiment of a strap (1120). Strap (1120) is substantially identical to strap (120) shown in FIGS. 5-7, except that strap (1120) does not include snaps (134). Tabs (1130) and attachment members (1132) are substantially identical to tabs (130) and attachment members (132) described above, so the description of those components will not be repeated here. In such an embodiment, snaps, such as snaps (134) described above, are attached somewhere other than on the strap, such as the exterior surface of the wearable article. The snaps are positioned so that at least one snap is adjacent to each respective tab (1130) once strap (1120) is incorporated within the wearable article. Additionally, the snaps in such an embodiment function substantially identically to snaps (134) described above. In other words, the snaps in such an embodiment are configured to engage a respective attachment member (1132), similar to snaps (134) described above, even though the snaps in such an embodiment are located on the exterior surface of the wearable article instead of on the strap.

Figure 11:
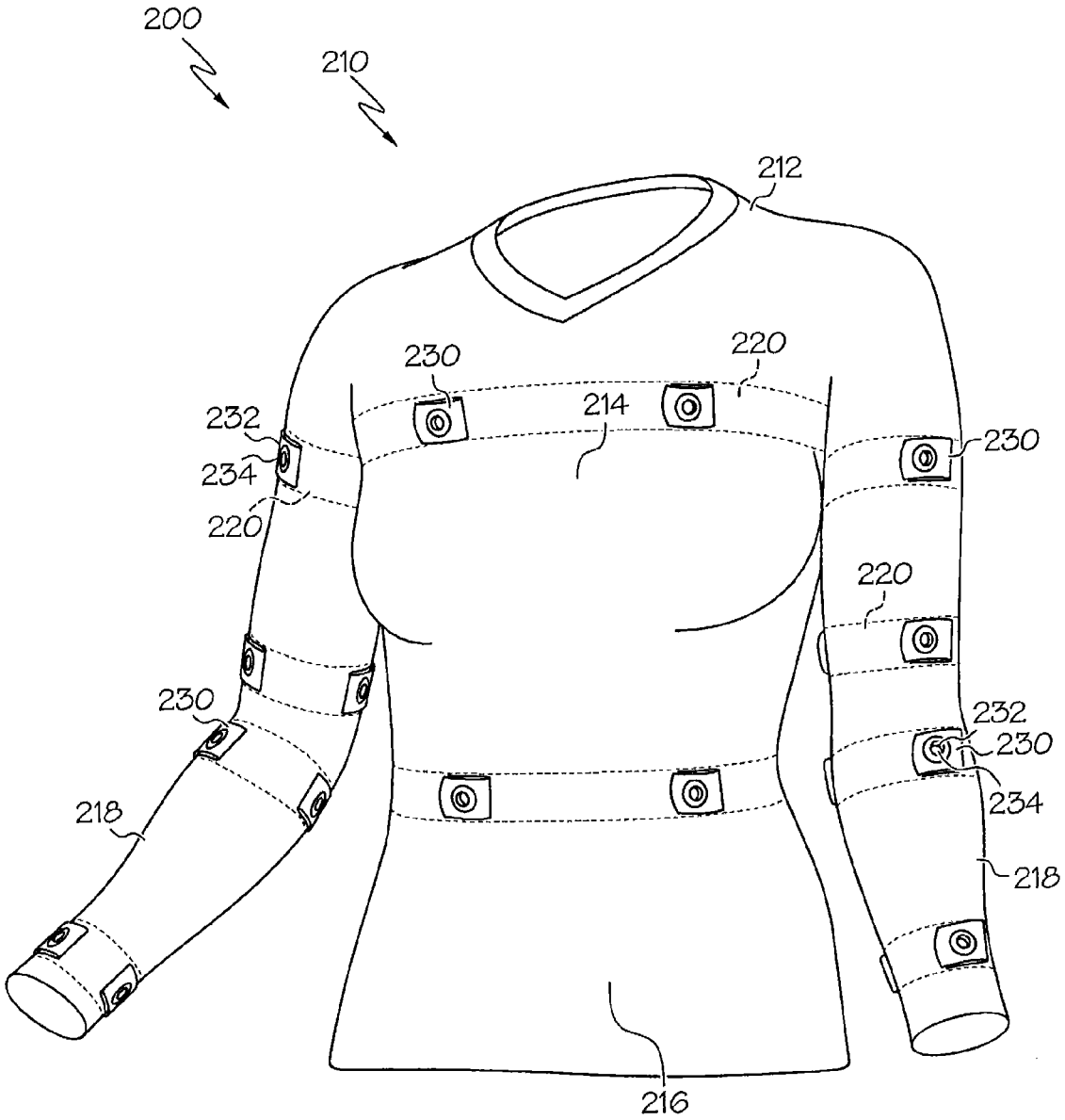
FIG. 11 depicts a perspective view of an exemplary alternative exercise device comprising a shirt.

FIG. 11 illustrates an alternative embodiment of an exercise device (200) comprising a shirt (210). As shown, shirt (210) comprises a shoulder portion (212), a chest portion (214), a torso portion (216), arm portions (218), straps (220) (shown in phantom), tabs (230), attachment members (232) and snaps (234). Similar to exercise device (100), described above, exercise device (200) is configured to approximate anatomical features of a user and may be similarly loose or tight. As described above with regard to exercise device (100), any suitable number and/or arrangement of straps (220), tabs (230), attachment members (232), and snaps (234) may be used for exercise device (200). Straps (220), tabs (230), attachment members (232), and snaps (234) function substantially the same as straps (120), tabs (130), attachment members (132), and snaps (134) for exercise device (100) described above.

Figure 12:
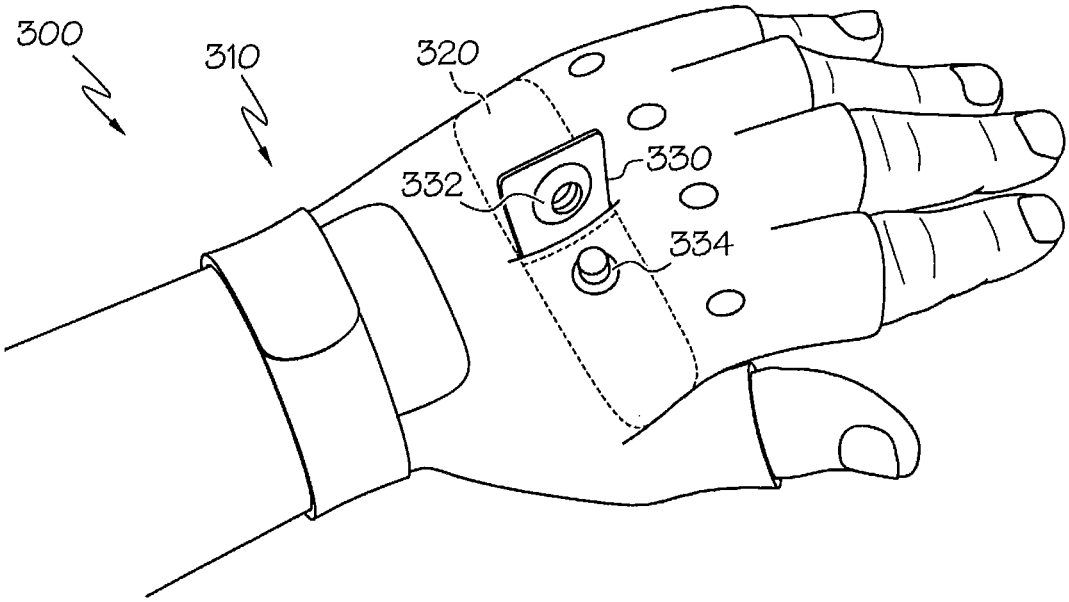
FIG. 12 depicts a top perspective view of an exemplary alternative exercise device comprising a glove.
Figure 13:
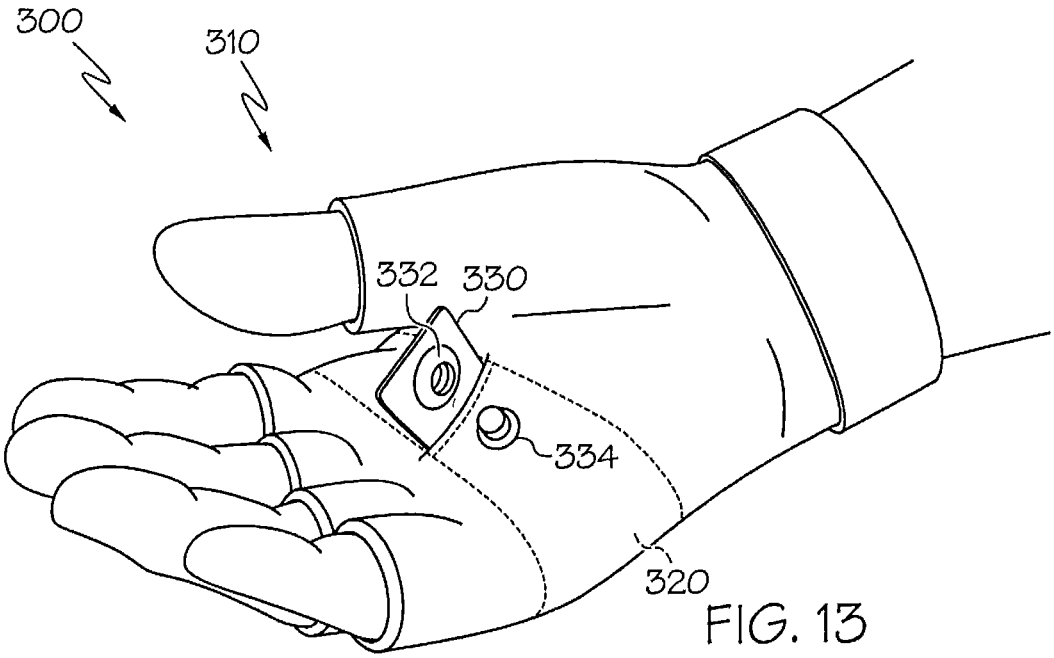
FIG. 13 depicts a bottom perspective view of the exercise device of FIG. 12.

FIGS. 12 and 13 illustrate another alternative embodiment of an exercise device (300) comprising a glove (310). As shown, glove (310) incorporates straps (320) (shown in phantom), tabs (330), attachment members (332) and snaps (334). As described above with regard to exercise device (100), any suitable number and/or arrangement of straps (320), tabs (330), attachment members (332), and snaps (334) may be used for exercise device (300). Straps (320), tabs (330), attachment members (332), and snaps (334) function substantially the same as straps (120), tabs (130), attachment members (132), and snaps (134) for exercise device (100) described above.

Figure 14:
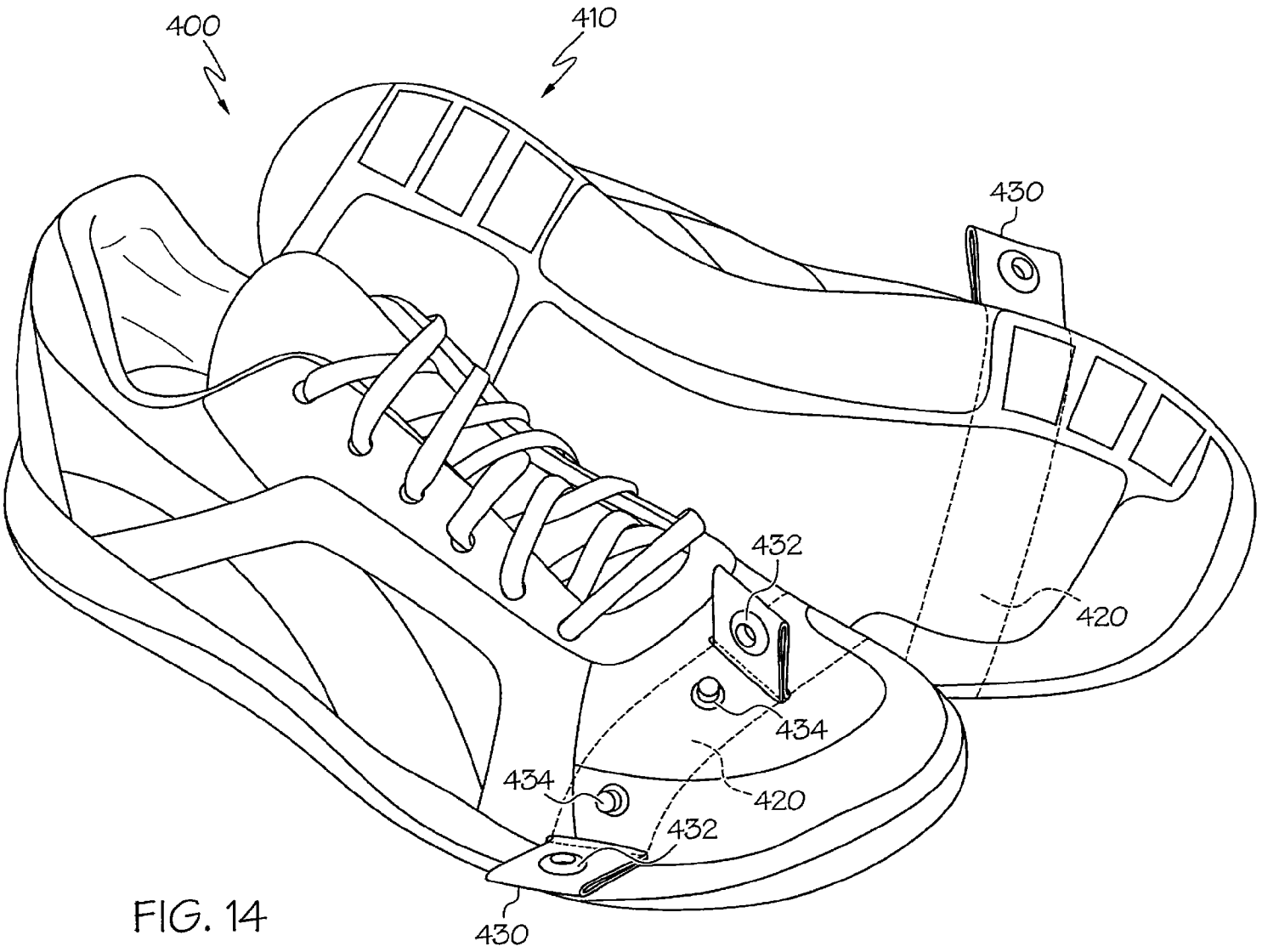
FIG. 14 depicts a perspective view of an exemplary alternative exercise device comprising footwear.

FIG. 14 illustrates another alternative embodiment of an exercise device (400) comprising footwear (410). As shown, footwear (410) incorporates straps (420) (shown in phantom), tabs (430), attachment members (432) and snaps (434). As described above with regard to exercise device (100), any suitable number and/or arrangement of straps (420), tabs (430), attachment members (432), and snaps (434) may be used for exercise device (400). Straps (420), tabs (430), attachment members (432), and snaps (434) function substantially the same as straps (120), tabs (130), attachment members (132), and snaps (134) for exercise device (100) described above.

Figure 15:
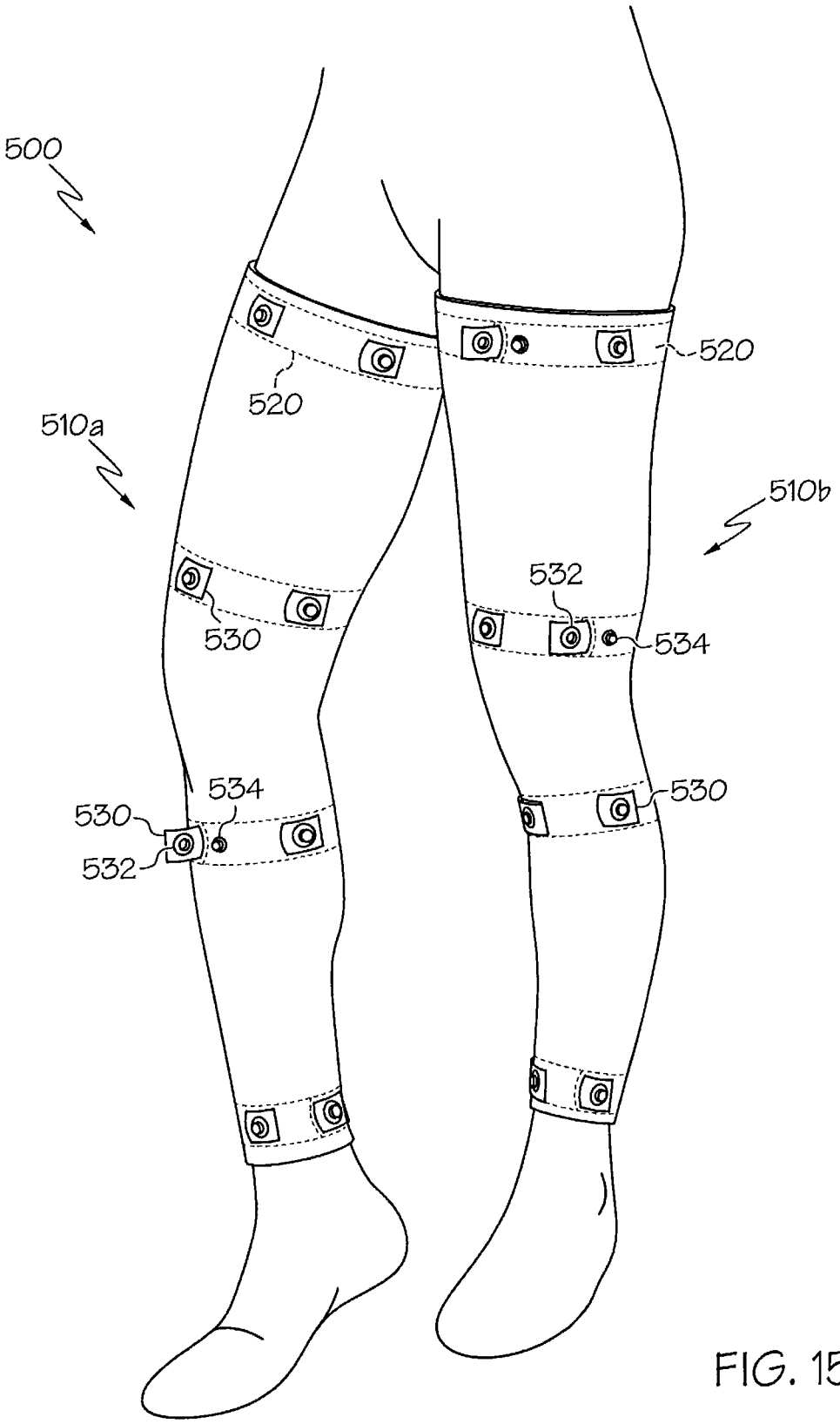
FIG. 15 depicts a perspective view of an exemplary alternative exercise device comprising a pair of sleeves.

FIG. 15 illustrates another alternative embodiment of an exercise device (500) comprising a pair of sleeves (510*a*, 510*b*) that are configured to partially cover a limb. In some embodiments, exercise device (500) may comprise a pair of sleeves (510*a*, 510*b*), as shown in FIG. 15, or a single sleeve (510*a*, 510*b*). In addition, sleeve (510*a*, 510*b*) may also be configured to be worn on a user's arm, as opposed to a user's leg, as shown in FIG. 15. As shown, each sleeve (510*a*, 510*b*) incorporates straps (520) (shown in phantom), tabs (530), attachment members (532) and snaps (534). As described above with regard to exercise device (100), any suitable number and/or arrangement of straps (520), tabs (530), attachment members (532), and snaps (534) may be used for exercise device (500). Straps (520), tabs (530), attachment members (532), and snaps (534) function substantially the same as straps (120), tabs (130), attachment members (132), and snaps (134) for exercise device (100) described above.

It should be understood that exercise devices (200, 300, 400, 500) are merely some of the alternatives and other suitable alternative exercise devices (not shown) may incorporate straps, tabs, attachment members and/or snaps similar to straps (120, 220, 320, 420, 520), tabs (130, 230, 330, 430, 530), attachment members (132, 232, 332, 432, 532), and snaps (134, 234, 334, 434, 534) described herein. For instance, straps (120, 220, 320, 420, 520), tabs (130, 230, 330, 430, 530), attachment members (132, 232, 332, 432, 532), and snaps (134, 234, 334, 434, 534) may be incorporated within other wearable articles such as footwear, headwear, jackets, gloves, socks, shorts, shirts, skirts, vests, sleeves, unitards, leotards, or the like. Such wearable articles may be made of any appropriate material, including by not limited to nylon, spandex, cotton, leather, or any combination thereof. Additionally, straps (120, 220, 320, 420, 520), tabs (130, 230, 330, 430, 530), attachment members (132, 232, 332, 432, 532), and snaps (134, 234, 334, 434, 534) may function in substantially the same way as described above when inserted into other wearable articles.

Figure 16:
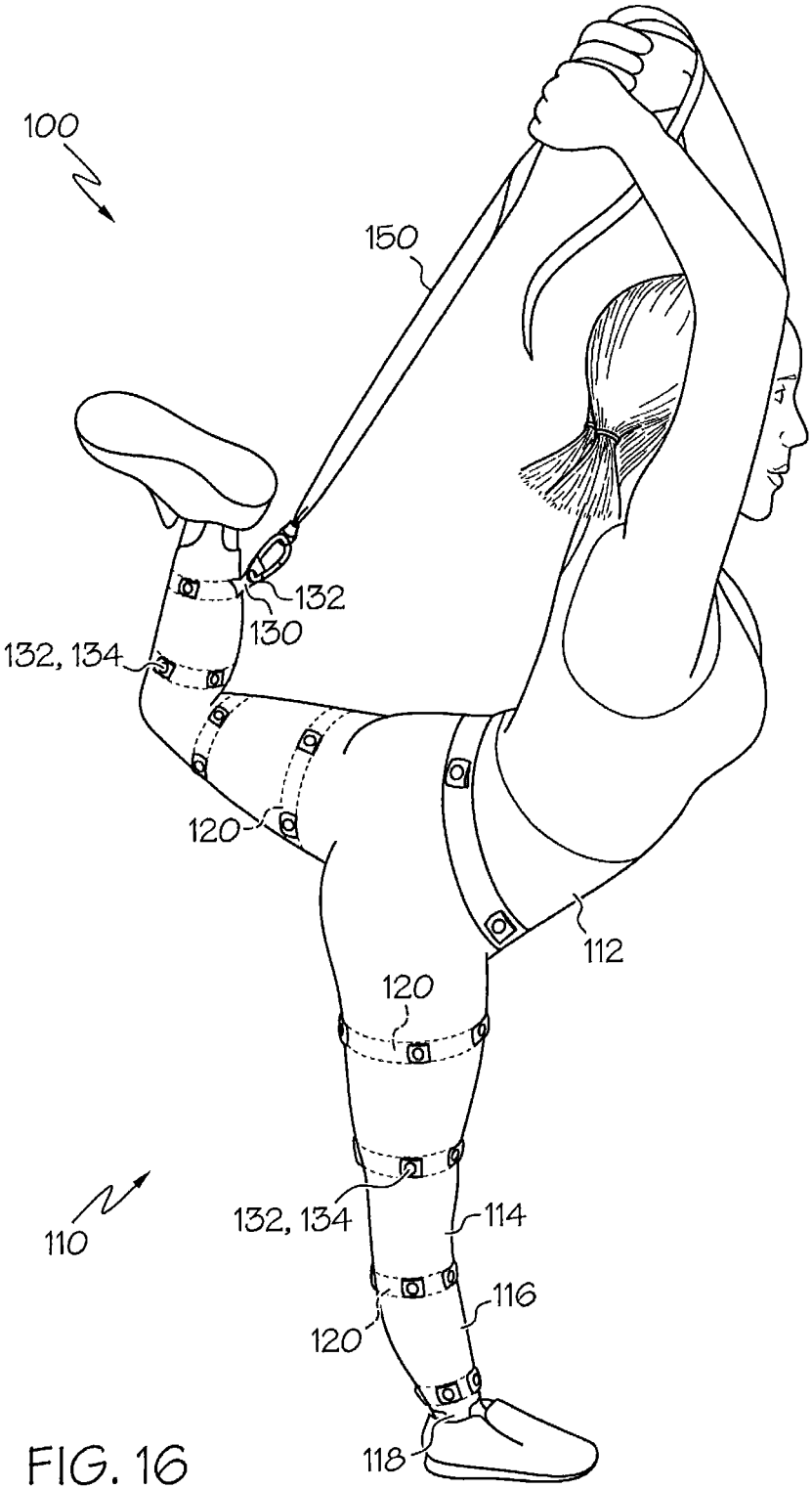
FIG. 16 depicts a perspective view of an exemplary use of the exercise device of FIG. 1.
Figure 17:
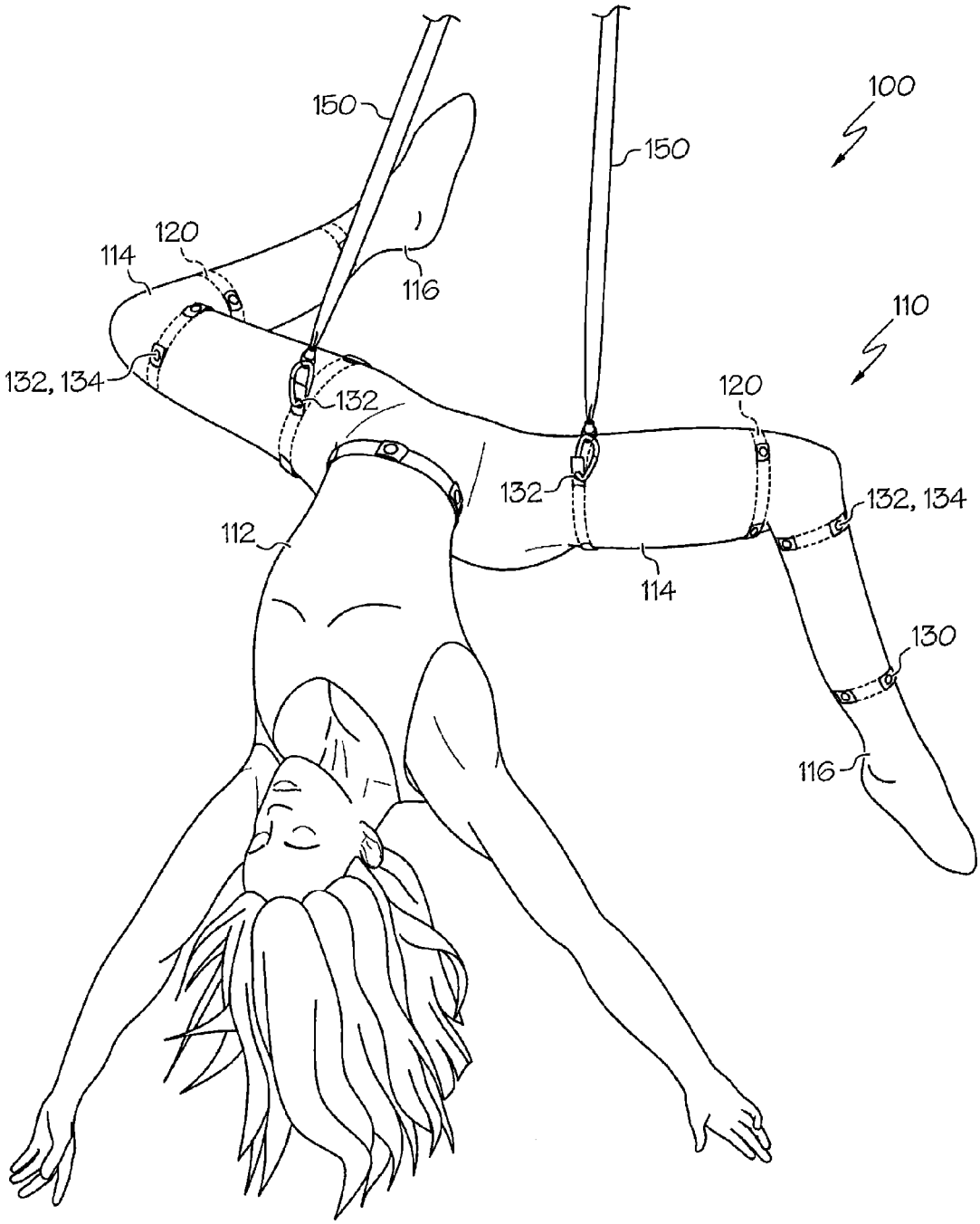
FIG. 17 depicts a perspective view of an alternative exemplary use of the exercise device of FIG. 1.
Figure 18:
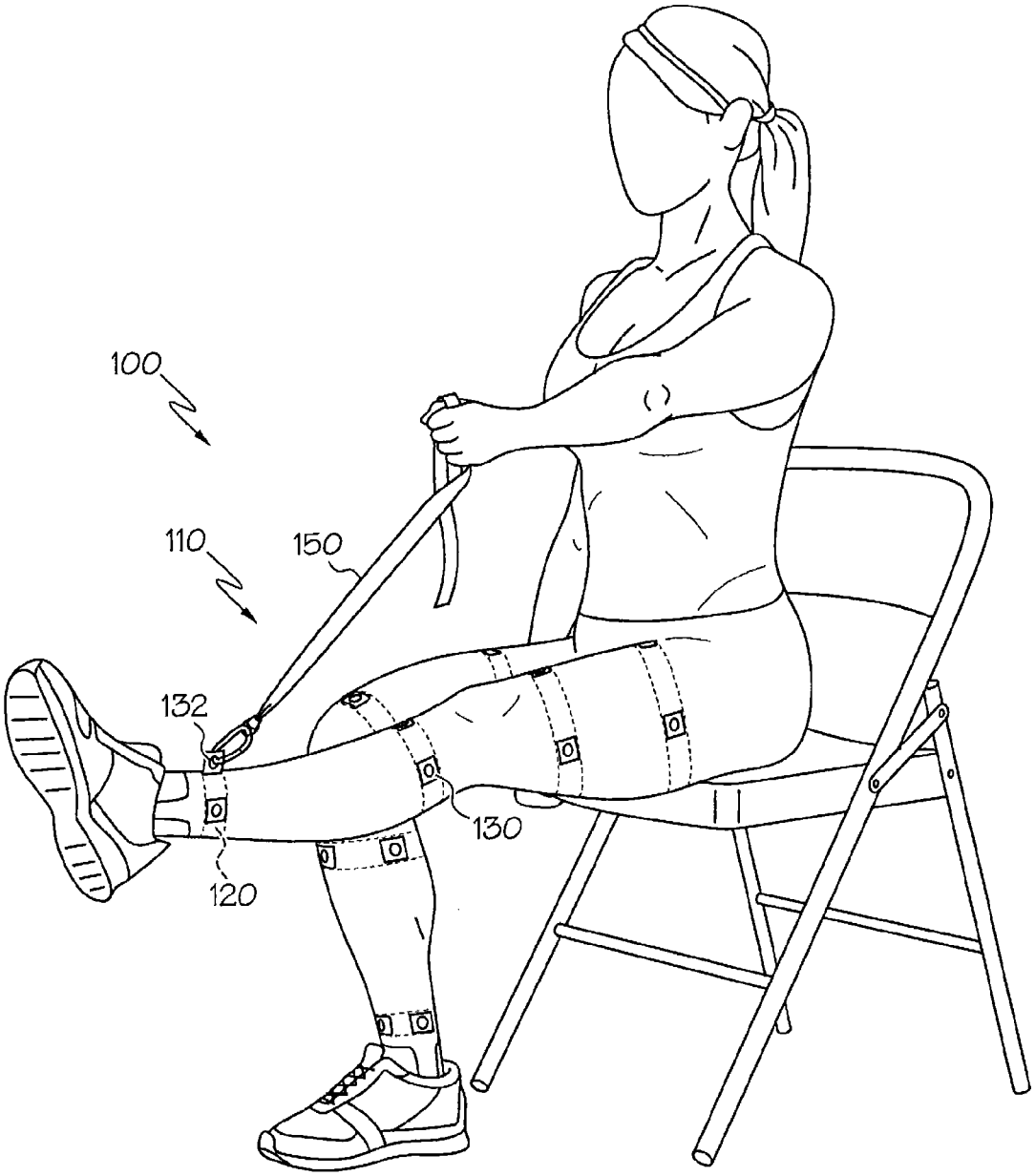
FIG. 18 depicts a perspective view of another alternative exemplary use of the exercise device of FIG. 1.

FIGS. 16-18 illustrate three exemplary uses of exercise device (100). Note that the version of pants (110) shown in FIG. 17 is substantially identical to pants (110) shown in FIG. 1, except in FIG. 17 the stirrups (118) have been replaced with a sealed end to enclose the feet of the user. Also note that the version of pants (110) shown in FIG. 18 is substantially identical to pants (110) shown in FIG. 1, except in FIG. 18 pants (110) do not include a strap (120) around the waist of pants (110). As can be seen in FIG. 16, a user may attach an exercise accessory (150) to a particular tab (130) of pants (110) permitting the user to engage in a stretching exercise. Similarly, as can be seen in FIG. 17, a user may attach multiple exercise accessories (150) to particular tabs (130) of pants (110) to engage in a suspension exercise and/or activity. By way of example only, such suspension may be beneficial for aerobic training, cheerleading training, physical therapy, or other suitable activities. When being used for suspension the exercise accessory (150) may be attached to any suitable support structure, including but not limited to a ceiling, a frame, handrails, parallel bars, banisters, or the like. As shown in FIG. 18, a user may attach an exercise accessory (150) to a particular tab (130) of pants (110) permitting the user to engage in a rehabilitation activity. Accordingly, a user may attach one or more medical rehabilitation tools for completing physical therapy regimes, including but not limited to those associated with sports or work related injuries.

Exercise accessories include (150) any device that may be selectively attached to a tab that can be used by a user to perform or in conjunction with performance of some exercise or activity. In some examples, exercise accessory (150) may be a device specifically made for use with exercise device (100). In other examples, exercise device (150) may be made by a third party that is compatible with exercise device (100). Moreover, exercise device (100) and exercise accessory (150) need not be specifically designed or used for physical exercise. Indeed, exercise device (100) and exercise accessory (150) may be used in conjunction with any suitable activity, such as for restraining a user, sexual play, physical therapy, injury rehabilitation, and/or other suitable activities.

As shown in FIGS. 16-18, the exercise accessories (150) may be attached to exercise device (100) by engaging attachment member (132) on a desired tab (130). Exercise accessory (150) may engage tab (130) with an engagement apparatus, such as a carabiner or any other device configured to securely attach the exercise accessory (150) to tab (130). By way of example only, any shape of locking or non locking carabiner (oval, D-shape, etc.) having any suitable gate type (straight, bent-gate, wire-gate, etc.) may be used to attach the exercise accessory (150) to the attachment member (132) in the desired tab (130).

Suitable exercise accessories (150) may include any device configured to attach to attachment members (132) of tabs (130). For instance, exercise accessories (150) may include straps, static or flexible bands, rods, levels, poles, chains, resistance bands, weights, sandbags, weighted sleds, training parachutes, medical rehabilitation tools (such as stretch bands), or the like. It should also be understood that a particular exercise accessory (150) may be selectively attached to any suitable tab (130) allowing for a variety of exercises and/or activities. Although FIGS. 16-18 illustrate stretching, suspension, and rehabilitation exercises or activities, other examples may include strength training (alone or with a partner), yoga, pilates, physical therapy maneuvers, etc. By way of example only, multiple users could attach opposite ends of an exercise accessory (150) to a respective tab being worn by each other to engage in a partner-based activity. In such a scenario, one user may serve as the fixed object while the other user completes an exercise activity or cycle. In another example, a user may attach a static band to a limb using an exercise device, such as pants (110), shirt (210), glove (310), footwear (410) or sleeve (510*a*, 510*b*), to stretch beyond normal capabilities without injury or dependence on a partner. Such a stretching activity may help increase the user's flexibility and range of motion. In yet another example, a user may attach one or more resistance bands, weights, sandbags or other exercise accessories for an effective and independent workout (e.g., (back, chest, core, glutes, legs and arms). Other suitable combinations of exercise accessories (150) with exercises and/or activities will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, uses, and the like discussed above are illustrative and are not required. Accordingly, the scope of the present invention should be considered in terms of any claims that may be presented and is understood not to be limited to the details of structure and operation shown and described in the specification and drawings.

What is claimed:

1. An exercise device, the exercise device comprising:

(a) a wearable article, wherein the wearable article is configured to be worn by a user;

(b) at least one strap, wherein the at least one strap is incorporated within the wearable article, wherein the at least one strap is configured to encircle a body part of the user;

(c) at least one tab formed by folding a portion of the at least one strap, wherein the at least one tab is integral with the at least one strap such that at least a portion of the at least one strap and at least a portion of the at least one tab are constructed from a single piece of material, wherein the at least one tab is configured to allow an exercise accessory to be selectively coupled to the at least one tab.

2. The exercise device of claim 1, wherein the wearable article comprises an interior surface, wherein the at least one strap is positioned adjacent to the interior surface of the wearable article.

3. The exercise device of claim 2, wherein the wearable article further comprises at least one pocket attached to an interior surface of the wearable article, wherein the at least one strap is positioned within the at least one pocket.

4. The exercise device of claim 3, wherein the at least one pocket comprises padding.

5. The exercise device of claim 2, wherein the at least one strap is attached directly to the interior surface of the wearable article.

6. The exercise device of claim 2, wherein the at least one tab protrudes through an opening in the wearable article.

7. The exercise device of claim 1, wherein the at least one tab comprises at least one attachment member.

8. The exercise device of claim 7, wherein the at least one attachment member is selected from the group consisting of a grommet and an eyelet.

9. The exercise device of claim 7, wherein the at least one strap comprises at least one snap, wherein the at least one snap is configured to selectively engage the at least one attachment member.

10. The exercise device of claim 7, wherein the wearable article comprises at least one snap, wherein the at least one snap is configured to selectively engage the at least one attachment member.

11. The exercise device of claim 1, wherein the wearable article is selected from the group consisting of a pair of pants, a shirt, a piece of footwear, a glove, and a sleeve.

12. The exercise device of claim 1, wherein the at least one strap and the at least one tab have a substantially continuous design.

13. The exercise device of claim 1, wherein the at least one strap comprises a padded material.

14. The exercise device of claim 1, wherein the at least one strap comprises at least one snap, wherein the snap is positioned adjacent to the at least one tab.

15. The exercise device of claim 1, wherein the at least one strap comprises a material selected from the group consisting of nylon, polypropylene, Kevlar®, cotton, elastic, leather, and rubber.

16. The exercise device of claim 1, wherein the at least one strap comprises a substantially inelastic material.

17. An exercise device, the exercise device comprising:

(a) a wearable article, wherein the wearable article is configured to be worn by a user, wherein the wearable article further comprises a pocket attached to an interior surface of the wearable article;

(b) a strap, wherein the strap is positioned within the pocket, wherein the strap comprises at least one interior portion, wherein the at least one interior portion of the strap forms a closed loop;

(c) a tab, wherein the tab is formed by folding a portion of the strap, wherein the tab extends from an exterior surface of the strap and through an opening in the wearable article; and (d) an attachment member, wherein the attachment member is positioned on the tab and is configured to allow the user to selectively couple an exercise accessory to the tab.

18. The exercise device of claim 17, wherein the tab and the strap are constructed from a single piece of material.

19. The exercise device of claim 17, further comprising at least one additional tab positioned on the strap, wherein the tab and the at least one additional tab are positioned equidistantly about the strap.

20. An exercise device, the exercise device comprising:

(a) a wearable article, wherein the wearable article is configured to be worn by a user, wherein the wearable article comprises an interior, wherein the wearable article further comprises an opening;

(b) a strap, wherein the strap is incorporated within the wearable article, wherein the strap comprises (i) a first interior section, (ii) a second interior section, (ii) a tab, wherein the tab comprises a first tab member having a first proximal end and a second tab member having a second proximal end, wherein the first proximal end of the first tab member is integral with the first interior section, wherein the second proximal end of the second tab member is integral with the second interior section, wherein the tab extends through the opening in the wearable article, and (iv) an attachment member, wherein the attachment member is positioned on the tab such that the attachment member secures the first tab member to the second tab member, wherein the attachment member is configured to allow the tab to be selectively coupled with at least one exercise accessory;

wherein the first interior section and the second interior section are located on the interior of the wearable article when the tab extends through the opening in the wearable article.

* * * * *